US005207290A

United States Patent [19]

Torok

[11] Patent Number: 5,207,290

[45] Date of Patent: May 4, 1993

[54] HINGE FOR FOLDING SAWHORSE

[76] Inventor: Andy J. Torok, P.O. Box 1166, Stone Mountain, Ga. 30086

[21] Appl. No.: 829,246

[22] Filed: Feb. 3, 1992

[51] Int. Cl.[5] ..... B27B 21/00

[52] U.S. Cl. ..... 182/153; 182/186; 182/226

[58] Field of Search ..... 182/153, 181, 186, 226, 182/225, 182-185, 224

[56] References Cited

U.S. PATENT DOCUMENTS

| | | | |
|---|---|---|---|
| 638,987 | 12/1899 | Porten | 182/153 |
| 2,343,557 | 3/1944 | Johnson | 182/186 |
| 3,024,865 | 3/1962 | Campbell | 182/226 |
| 3,696,887 | 10/1972 | Brzykcy | 182/186 X |
| 5,052,517 | 10/1991 | Wallman et al. | 182/181 X |

*Primary Examiner*—Alvin C. Chin-Shue
*Attorney, Agent, or Firm*—James B. Middleton

[57] ABSTRACT

A sawhorse has a pair of legs on each side of the longitudinal beam, and the two pair of legs are movable towards each other for folding the sawhorse. The hinge for allowing motion of the legs is made up of a bolt extending through the beam, with openings in each leg to receive an end of the bolt. The openings in the legs have one wall to limit the outward movement of the leg by engaging the bolt, and another wall to limit the inward movement of the leg. Nuts or other stops hold the legs on the bolts. A latching block may be fixed to the lower surface of the beam, between the legs. The block can be rotated to extend between the legs and prevent folding, or to extend along the beam and allow folding.

1 Claim, 2 Drawing Sheets

HINGE FOR FOLDING SAWHORSE

INFORMATION DISCLOSURE STATEMENT

Sawhorses are very well known in the art and have broad utility. In the past, sawhorses were fabricated when needed and destroyed when the particular job was completed. With increasing costs of materials, and increasing sensitivity to ecological matters, sawhorses are fabricated, and retained throughout their useful life. Furthermore, sawhorses are often mass manufactured rather than being fabricated by the user. With these later developments, there has been more interest in providing a folding sawhorse to lessen the storage space required for moving and storing the sawhorse.

Most of the prior art foldable sawhorses are designed so that the legs can be simply folded in some fashion. In most cases, however, there are screws to be loosened to allow the saw horse to fold. While such sawhorses in fact fold, some considerable amount of time is required to fold the sawhorse. Thus, in moving sawhorses a short distance, or storing them for a short time, the ability to fold is not very helpful. One prior art sawhorse includes a quick-folding arrangement, as disclosed in U.S. Pat. No. 4,403,678, but this structure requires a double beam. Additionally, flexible connectors are required to limit the outward motion of the legs while the sawhorse is in use.

Other prior art patents that are relevant to the sawhorse of the present invention include U.S. Pat. Nos. 2,721,060 to Morain and 4,711,319 to Sansotta et al. The Morain patent has legs that pivot on a horizontal bolt to move to the folded position, but the sawhorse is fabricated of sheet metal, and the leg must be hooked into the beam to become stable. The bolt does not provide stability, but only convenience in holding the pieces together. The Sansotta et al. patent has legs that pivot on a bolt, but the strength is from the legs abutting each other, in conjunction with a foldable spacer.

SUMMARY OF THE INVENTION

This invention relates generally to sawhorses and the like, and is more particularly concerned with a hinge arrangement for a sawhorse having easily foldable legs that open to yield a stable sawhorse.

The present invention provides a hinge for a foldable sawhorse wherein bolts pass laterally through the beam of the sawhorse. Each pair of legs is received over a bolt or shaft, and each leg defines an opening so shaped as to allow the leg to pivot inwardly, and to pivot outwardly to a predetermined angle. Stops on each end of the shaft prevent further movement of the legs away from each other to provide a stable sawhorse. Longitudinal bracing on the legs renders each pair of legs stable so movement is only towards and away from the opposing pair of legs. When required, a latch block can prevent inadvertent folding of the legs.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
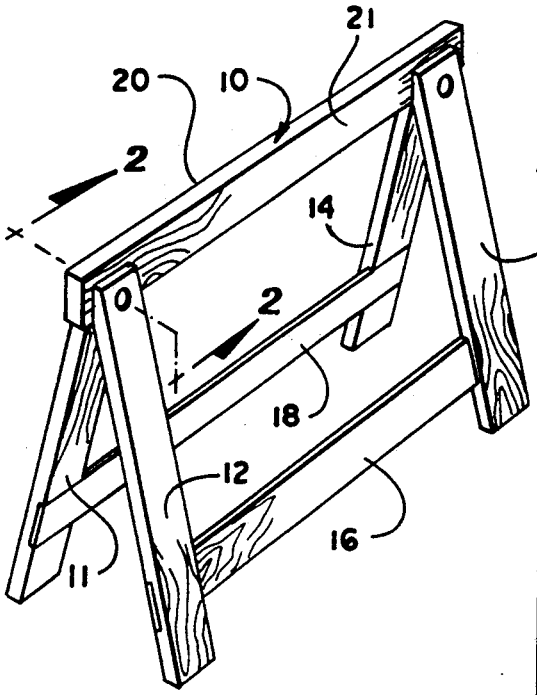
FIG. 1 is a perspective view showing a foldable sawhorse made in accordance with the present invention.

Referring now more particularly to the drawings, and to that embodiment of the invention here presented by way of illustration, FIG. 1 shows a sawhorse including a beam 10, with four legs designated at 11, 12, 14 and 15. The four legs are paired in two ways: the legs 11 and 12 are paired in that they are opposed to each other and operate on one bolt; and, the legs 12 and 15 are paired in that they are rigidly connected by the longitudinal brace 16. Thus, the legs 11 and 12 operate on one bolt and the legs 14 and 15 operate on one bolt. The legs 12 and 15 are connected for movement together, and the legs 11 and 14 are connected by the brace 18 for movement together.

It will be noticed in FIG. 1 of the drawings that there is no brace or other interconnecting means between the legs 11 and 12 or between the legs 14 and 15. This fact allows the sawhorse to fold easily. As will be discussed in more detail hereinafter, one can simply lift the sawhorse by the beam 10, and the legs 11 and 14 and the legs 12 and 15 will pivot towards each other, and the sawhorse will be folded.

Figure 2:
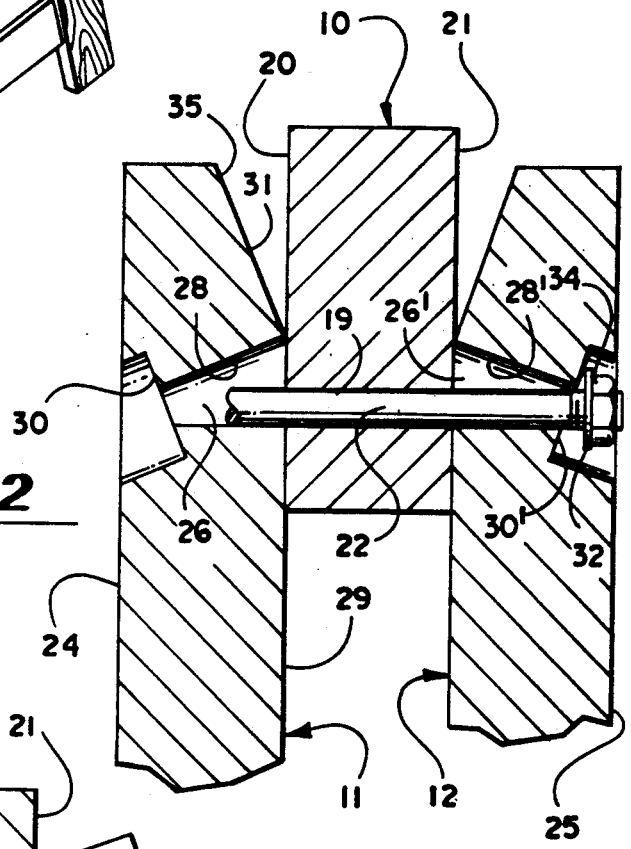
FIG. 2 is an enlarged cross-sectional view taken along the line 2—2 in FIG. 1.

Attention is now directed to FIG. 2 of the drawings for a discussion of the construction of the hinge means of the present invention. It will be seen that the beam 10 has a hole 19 therethrough, the hole 19 being perpendicular to the vertical sides 20 and 21 of the beam 10. A bolt 22 is received within the hole 19, and extends beyond the sides 20 and 21, terminating in threaded ends.

Each of the legs 11 and 12 has an opening to receive an end of the bolt 22; and, the outer surfaces 24 and 25 respectively of legs 11 and 12 are counterbored around the openings. The left hand end of the bolt 22 is broken away to show the opening more clearly, and it will be noticed that the opening 26 in the leg 11 has an upper wall 28 that is perpendicular to the side 20 of the beam 10, and is coextensive with the upper edge of the hole 19 through the beam 10. While not here shown, it should be realized that the width of the opening 26 is slightly larger than the diameter of the bolt 22, just sufficient to allow easy movement of the opening relative to the bolt.

The lowermost wall of the opening 26 is perpendicular to the inside surface 29 of the leg 11, and the wall extends across the leg 11 to provide an opening into the counterbore for allowing the bolt 22 to extend therethrough. The bottom 30 of the counterbore is then disposed perpendicularly to the upper wall 28 of the recess 26.

It can also be seen in FIG. 2 that the upper ends of the legs 11 and 12 are beveled to provide a flat face 31 on the leg 11 for abutting the side 20 of the beam 10. With the flat face 31 abutting the side 20, the leg 11 extends down and out at an angle of about 22½°. It will be obvious to those skilled in the art that this angle is not critical; but, if each leg 11 and 12 is at a 22½° angle, the total angle between the legs will be 45°, which is sufficient for a stable sawhorse. A wide range of angles is equally possible for a successful sawhorse.

The foregoing description applies equally to the right hand end of the bolt 22 and the leg 12. The description will not be repeated, but the primes of numerals will be applied to equivalent parts that have not been given separate reference numerals.

The right hand end of the bolt 22 is shown as having a washer 32 and a nut 34 to act as a stop means. It is contemplated that the opposite end (not shown) of the bolt 22 will include a similar stop means. The bolt 22 may be threaded at both ends to receive a nut on each end, or of course the bolt may have a head on one end to act as the stop means.

Figure 3:
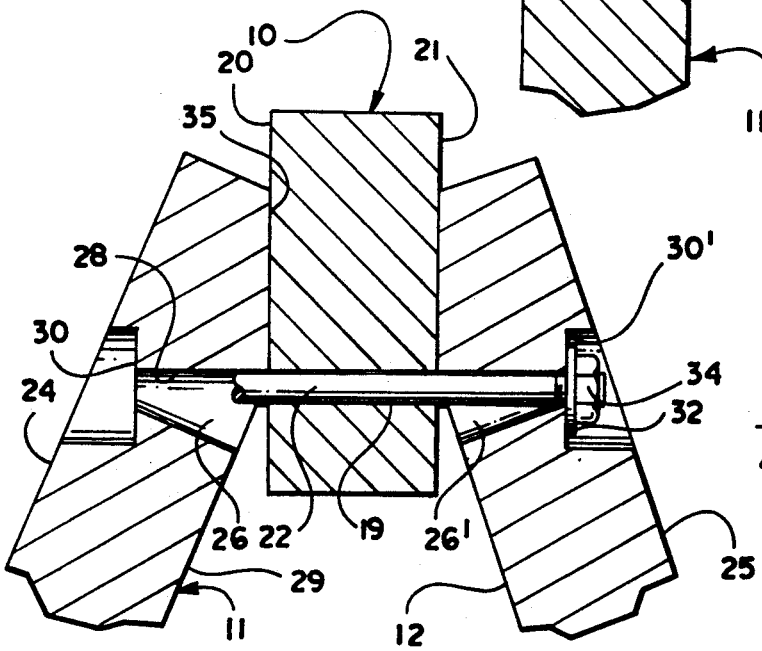
FIG. 3 is a view similar to FIG. 2 but showing the legs in folded position.

With the above description in mind, and looking at FIG. 3 of the drawings, it should be understood that, with the parts as shown in FIG. 1 of the drawings, downward force on the beam 10 will cause the legs 11 and 12 to tend to separate, moving away from each other. The leg 11 (for example) will tend to rotate about the point 35 at the top of the flat face 31, and the resistance to such rotation is provided by the nut and washer held against the bottom 30 of the counterbore. Since the nut will be fixed to the bolt 22, it will be obvious that the bolt 22 is held in tension by similar forces on each end.

When the sawhorse is to be folded, one needs only to lift the beam 10 to remove the holding forces from the legs 11, 12, 14 and 15. The weight of the leg 11 (for example) will tend to urge the leg 11 to pivot inwardly, towards the leg 12. Because the opening 26 is vertically elongated at the inner surface 29 of the leg 11, the leg 11 is free to move inwardly, pivoting about the junction of the opening 26 and the counterbore. The lowest point on the flat face 31 is at or above the pivot point, so the flat face tends to move away from the side 20 of the beam 10. This allows the leg 11 in fact to move inwardly, constrained by the stop means on the bolt 22. The fully folded position is shown in FIG. 3, and it can be seen that the position is maintained by engagement of the stop means such as the washer 32 and nut 34 with the bottom 30' of the counterbore.

It will therefore be understood that the present invention provides a hinge for a sawhorse wherein a single bolt or other shaft passes laterally through the beam of the sawhorse. The shaft is preferably snugly fitted in the hole: by way of example, a ⅜" diameter hole may receive a ⅜" diameter shaft. Opposing legs then have openings therein to receive an end of the shaft. When the legs are in their opened position, the upper wall of the recess will engage the shaft, and an angled flat face of the leg will engage the beam of the sawhorse. When the legs are in their folded position, the lower wall of the recess will engage the shaft. In the open position, stop means on the shaft limit the outward pivoting of the legs; and, in the closed position, the stop means hold the legs on the shaft.

Those skilled in the art will recognize that, in some situations, it will be desireable to prevent easy folding of the legs of the sawhorse. By way of example, when a board is resting on the beam 10 of the sawhorse, and is slid transversely to the beam, the two of the legs will sometimes be lifted enough that the sawhorse will fold. Also, when a sawhorse is in use, but is to be moved a short distance, it may be inconvenient to have to unfold the sawhorse before setting it down. Thus, it may sometimes be desirable to latch the legs in their unfolded position.

Figure 4:
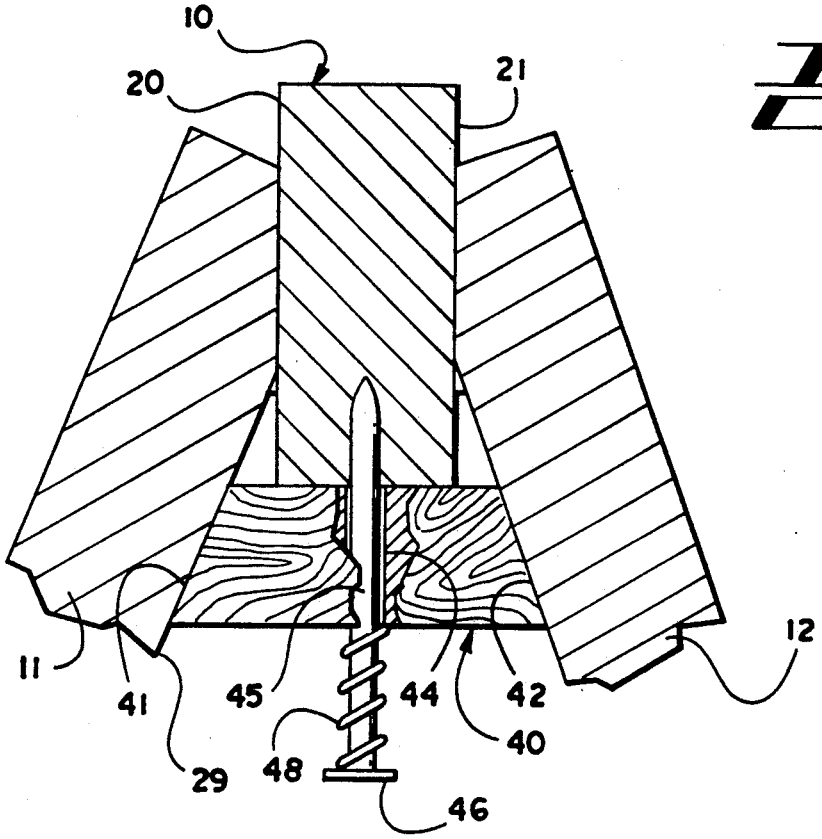
FIG. 4 is a view similar to FIG. 2, but showing the latch block that may be used with the device shown in FIGS. 1-3; and, FIG. 5 is a fragmentary view showing the front elevation of FIG. 4.
Figure 5:
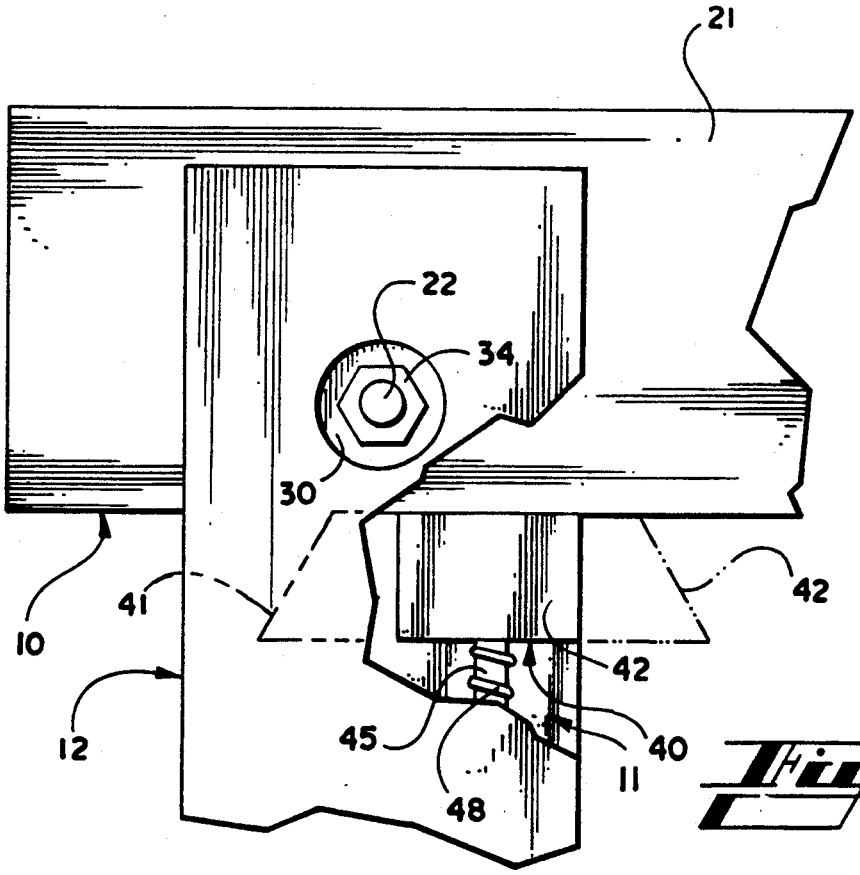

The latch block shown in FIGS. 4 and 5 of the drawings comprises a block 40 having angled ends 41 and 42 so the shape as viewed in FIG. 4 is trapezoidal. The ends 41 and 42 are at the same angle as the legs 11 and 12. Thus, when the block 40 is in place as shown in FIG. 4, the block 40 abuts the lower side of the beam 10, and the ends 41 and 42 engage the inner surfaces of the legs 11 and 12. It will be readily understood that, with the block 40 so placed, the legs 11 and 12 will be unable to fold.

To hold the block 40 in place, the block 40 defines a hole 44 therethrough, the hole 44 receiving a pin 45. The pin 45 has an enlarged head 46, and a spring 48 surrounds the pin 45 between the block 40 and the head 46. As a result of this construction, the block 40 can be moved down, against the tension of the spring 48, so the block no longer engages the legs 11 and 12. The block 40 can then be rotated to be along the beam 10 as is shown in phantom in FIG. 5 of the drawings.

The latch block can be placed anywhere between the legs 11 and 12, or between the legs 14 and 15; however, it is desirable not to allow the block 40 to protrude outside the legs. The preferred placement is therefore as shown in FIG. 5, where it will be seen that, when the block 40 is in the locking position, the front surface of the block 40 is aligned with the inside edges of the legs 11 and 12.

Additionally, one convenient means for attaching the latching block to the sawhorse is to utilize a common nail as the pin 45, so the pin can be simply driven into the beam 10. In so doing, the pin 45 should avoid interference with the bolt 22. Placement of the latch block as shown in FIG. 5 displaces the pin 45 from the bolt 22.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a sawhorse including a beam extending longitudinally of said sawhorse, and at least two opposed legs, hinge means for hingedly fixing said legs to said beam, said opposed legs being movable towards each other for disposing said sawhorse in a folded condition and away from each other for disposing said sawhorse in an open condition, the improvement wherein said hinge means comprises a shaft extending laterally through said beam, and stop means on the ends of said shaft for defining a fixed length for said shaft, each leg of said at least two legs defining an opening therein for receiving an end of said shaft between said beam and said stop means, said opening having an upper wall that is contiguous with said shaft when said legs are moved away from each other, and a lower wall that is contiguous with said shaft when said legs are moved towards each other, said legs including upper ends engaged with the sides of said beam when said legs are moved away from each other, and wherein said upper ends of said legs include flat faces contiguous with the sides of said beam when said legs are moved away from each other, said upper walls of said openings being perpendicular to said flat faces, said lower walls of said openings being perpendicular to the inner faces of said legs, the arrangement being such that said legs pivot generally at said stop means in moving from said open condition to said closed condition, latching means for selectively preventing said opposed legs from moving towards each other, said latching means comprises a block extending laterally of said beam and located between said at least two legs, and a pin for movably fixing said block to said beam, said block being selectively rotatable on said pin for selectively causing and preventing engagement of said block with said legs, the improvement wherein said latching means includes spring means for urging said block into engagement with said beam.

* * * * *